US005129104A

United States Patent [19]

Leopoldi et al.

[11] Patent Number: 5,129,104

[45] Date of Patent: Jul. 14, 1992

[54] BELT OR BAND WITH HOLLOW OPENING FOR RECEIVING THEREIN THE BUCKLE-END THEREOF AND METHOD OF MAKING SAME

[76] Inventors: Norbert Leopoldi; Regine Leopoldi, both of 4180 Marine Dr., Chicago, Ill. 60613

[21] Appl. No.: 731,789

[22] Filed: Jul. 19, 1991

[51] Int. Cl.[5] ..... A41F 9/00

[52] U.S. Cl. ..... 2/322; 2/311; 2/338; 2/312

[58] Field of Search ..... 2/322, 320, 321, 311, 2/312, 316, 338

[56] References Cited

U.S. PATENT DOCUMENTS 2,885,685 5/1959 Carr et al. ..... 2/338

3,501,775 3/1970 Demers et al. ..... 2/321

*Primary Examiner*—Werner H. Schroeder
*Assistant Examiner*—Gloria Hale
*Attorney, Agent, or Firm*—Milton S. Gerstein

[57] ABSTRACT

An apparel belt has a first tapered end-portion that passes through a conventional buckle of the belt. The second end-portion of the belt, which mounts the buckle, is slightly larger in diameter than the first end-portion, which second end-portion defines an open entrance mouth and a hollow interior volume which telescopingly receives therein a section of the first end-portion, depending upon the length of the first end-portion extending through the buckle. The interior volume may also be used for storing valuables therein before inserting the first end-portion therein.

10 Claims, 1 Drawing Sheet

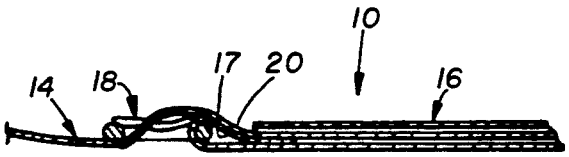
FIG. 2
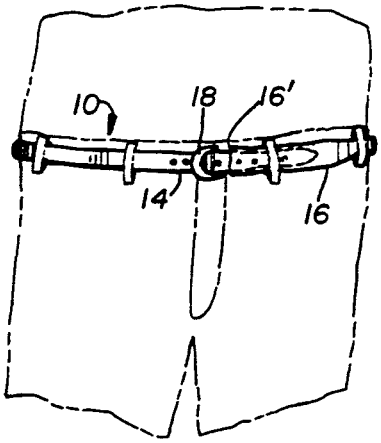
FIG. 1
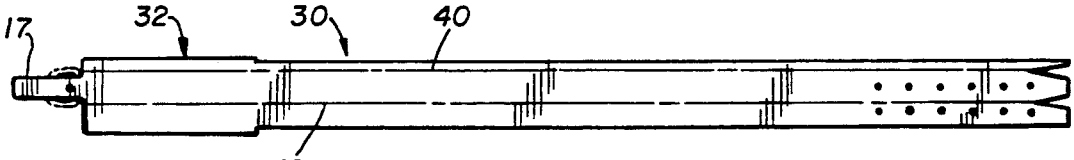
FIG. 3
FIG. 4
FIG. 6
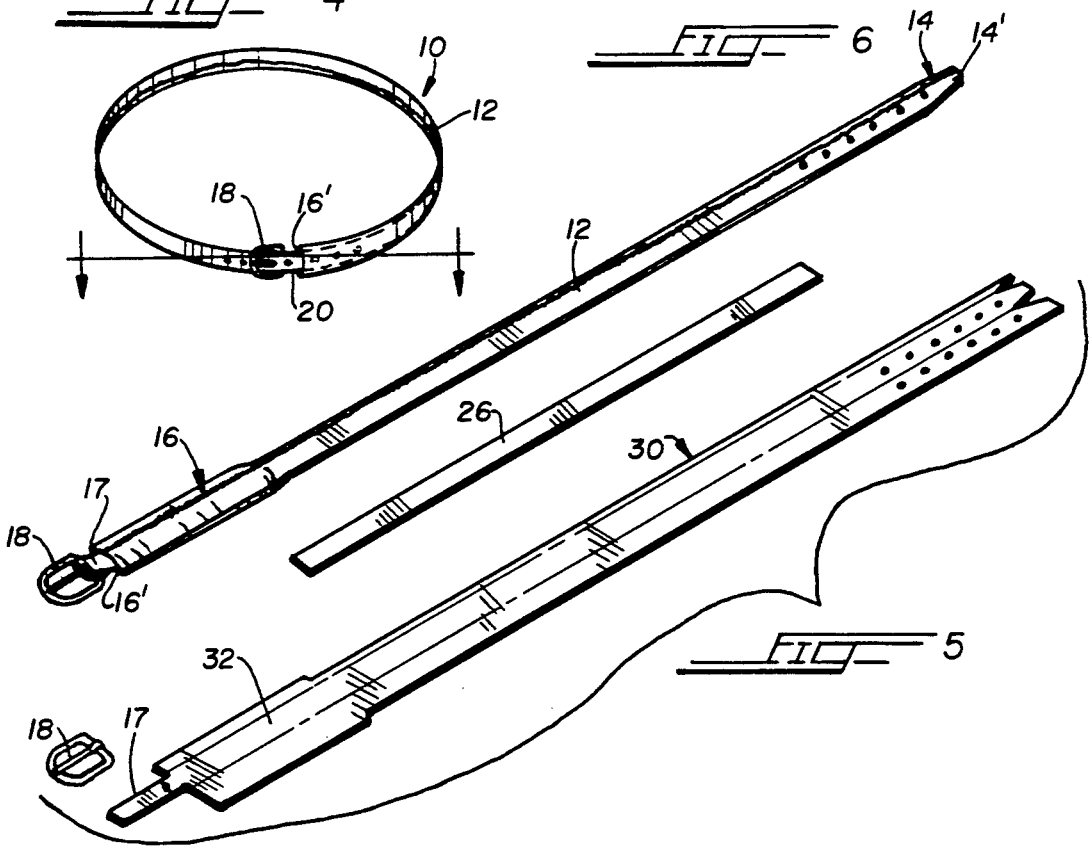
FIG. 5

BELT OR BAND WITH HOLLOW OPENING FOR RECEIVING THEREIN THE BUCKLE-END THEREOF AND METHOD OF MAKING SAME

BACKGROUND OF THE INVENTION

The present invention is directed to a belt for pants, and the like. The main objective of the invention is to provide a high-quality belt that in which the first end thereof, after having passed through the securing buckle of the belt, is inserted into the hollow interior of the other, second end of the belt, whereby the first end is not visible, is more securely held in place, and does not interfere with the person.

SUMMARY OF THE INVENTION

The belt of the invention has a first tapered end-portion that passes through a conventional buckle of the belt. The second end-portion of the belt, which mounts the buckle, is slightly larger in diameter than the first end-portion, which second end-portion also defines a hollow interior volume which telescopingly receives therein a section of the first end-portion, depending upon the length of the first end-portion extending through the buckle, which depends upon the size of the person wearing the belt. The interior volume may also be used for storing valuables therein before inserting the first end-portion therein.

BRIEF DESCRIPTION OF THE DRAWINGS

The invention will be more readily understood with reference to the accompanying drawing, wherein:

FIG. 1 is a front view of the belt of the invention shown worn about pants;

FIG. 2 is a cross-sectional view taken along line 2—2 of FIG. 4;

FIG. 3 is a plan view showing the blank of leather material form which the belt of the invention is made;

FIG. 4 is an isometric view of the belt;

FIG. 5 is an assembly view, in perspective, showing how the stiffening member is formed in the belt of the invention; and FIG. 6 is a perspective view showing the finished belt.

DETAILED DESCRIPTION OF THE INVENTION

Referring now to the drawings in greater detail, and to FIGS. 1-4, the belt of the invention is indicated generally by reference numeral 10. The belt is preferably made of high-quality, genuine leather, and has a main portion 12, a first, tapered end-portion 14, a second, slightly-larger end-portion 16, and a conventional buckle-element 18 mounted at the second end portion, which is connected to the mouth of the end-portion 16 via a strip of material 17. In the conventional manner, in using the belt, one passes the first end-portion 14 through the buckle element 18. The length of the section 20 of the first end-portion 14 that extends outwardly of the buckle element 18, toward the second end-portion 16, depends upon the length of the belt proper, and the size of the person wearing the belt: The larger the person, the shorter the section 20. The second end-portion 16 has a hollow interior volume that receives therein, in telescoping fashion, the section 20. The end-portion 16 has a slightly larger width than the untapered part of the end-portion 14, so as to accommodate therein any section length 20. The tapered end 14' of the end-portion 14 assists in the insertion of the first end-portion into the mouth 16' of the hollow interior volume of the second end-portion 16. The second end-portion 16 defines a hollow interior volume for a length sufficient enough so as to accommodate a person wearing the belt of the smallest girth. In the preferred embodiment, this hollow interior may extends between 1/16 and ¼ of the length of the belt. The part of the belt between the first and second end-portions is provided with a stiffening member 26. The hollow interior of the second end-portion may also be used for storing valuables, such as jewelry, and the like, before inserting the first end-portion therein, in order to provide a safe place for storage while transporting the valuables.

FIGS. 5 and 6 show the method of making the belt 10. Since the second end-portion 16 must be provided with a wider mouth or opening 16', a strip of leather material 30 from which the belt is made must have a wider end-portion 32 that will constitute the second end-portion 16 after the belt is formed. The strip of leather 30 is folded along lines 40, 42 and then sewn or stitched, to leave the wider end-portion 16.

The belt 10 may also be made into a band for a watch, or the like, the only difference being the size and overall length. With reference to FIG. 5, the strip 30 from which the belt 10 is formed is actually cut out from a rectangular piece of leather, or other material. In forming the strip 30, the rectangular piece of material is cut away to form the shape of the strip 30 as shown in FIG. 5. This cut-away material is not wasted, but itself is used for forming a watch-band, or similar product, using the same principal as the making of the belt 10. That is, each piece of cut-away material to form the strip 30 is further cut into the same shape as the strip 30, though of much reduced length and width, which itself is folded and stitched to form a watch-band identical in function and use as the belt 10, though on a smaller scale.

While a specific embodiment of the invention has been shown and described, it is to be understood that numerous changes and modifications may be made therein without departing from the scope, spirit and intent of the invention as set forth in the appended claims.

What we claim is:

1. In a belt or band comprising a first end-portion, a second end-portion, a buckle mounted at said second end-portion for receiving therethrough at least a section of said first end-portion, the improvement comprising:

said second portion having a hollow interior and an open mouth leading to said hollow interior for telescopingly receiving therein at least part of said first end-portion.

2. The belt or band according to claim 1, wherein said first end-portion comprises a tapered end to assist in the insertion of said first end-portion in said second end-portion.

3. The belt or band according to claim 1, wherein said mouth and said hollow interior of said second end-portion is wider than said first end-portion.

4. The belt or band according to claim 3, wherein said second end-portion and said hollow interior thereof extends for approximately between 1/16 and ¼ of the length of the belt.

5. The belt or band according to claim 3, wherein said first end-portion comprises a tapered end to assist in the insertion of said first end-portion in said second end-portion.

6. The belt or band according to claim 4, wherein said first end-portion comprises a tapered end to assist in the insertion of said first end-portion in said second end-portion 7. The belt or band according to claim 3, wherein the width of said second end-portion is slightly greater than the width of said first end-portion.

8. A method of making an apparel belt, comprising:

(a) forming a strip of belt material having a first enlarged-width end section and a second end section;

(b) placing a stiffening member on the strip between the end sections;

(c) folding the strip along a longitudinal line and, thereafter, stitching said folded strip;

(d) said step (c) comprising forming a belt having a wider end-portion defining an open entrance mouth and a hollow interior formed by said enlarged-width section of said strip, with the other end-portion of the belt being defined by said second end section of the strip; and (e) securing a buckle to said first wider end-portion through which buckle may pass said second end-portion of the belt.

9. The method according to claim 8, wherein said step (a) comprises tapering said second end section of the strip.

10. The method according to claim 8, wherein said step of forming a strip of belt material having a first enlarged-width end section and a second end section comprises cutting a blank piece of material and removing portions thereof in order that the leftover material from the blank piece is a strip having said first enlarged-width end section and said second end section; folding each said cut-away and removed strip along a longitudinal line and, thereafter, stitching said folded strip; said step of folding comprising forming a band having a wider end-portion defining an open entrance mouth and a hollow interior formed by said enlarged-width section of said strip, with the other end-portion of the band being defined by said second end section of the strip; and securing a buckle to said first wider end-portion through which buckle may pass said second end-portion of the band.

* * * * *